US007455014B2

(12) United States Patent
Zanella

(10) Patent No.: US 7,455,014 B2
(45) Date of Patent: Nov. 25, 2008

(54) PROCESS FOR PRODUCING A PLASTIC PELLICLE AND/OR FILM IN A CONTINUOUS CYCLE IN THE PRINT FINISHING OF HIDES, SYNTHETIC MATERIALS OR ANY OTHER SUPPORT

(76) Inventor: Bruno Zanella, Via Monte Cervino, 6, 37057 San Giovanni Lupatoto, Verona (IT)

( * ) Notice: Subject to any disclaimer, the term of this patent is extended or adjusted under 35 U.S.C. 154(b) by 0 days.

(21) Appl. No.: 11/042,224

(22) Filed: Jan. 25, 2005

(65) Prior Publication Data

US 2005/0170085 A1 Aug. 4, 2005

(30) Foreign Application Priority Data

Feb. 4, 2004 (IT) ..... VR2004A0014

(51) Int. Cl.
*B41M 3/12* (2006.01)

(52) U.S. Cl. ..... 101/491; 101/33; 427/258

(58) Field of Classification Search ..... 101/491, 101/33, 34; 156/384, 277, 387, 239, 240, 156/230; 427/256, 258, 259, 265, 282
See application file for complete search history.

(56) References Cited

U.S. PATENT DOCUMENTS

| | | | | |
|---|---|---|---|---|
| 2,758,035 | A * | 8/1956 | Matthes | 428/41.6 |
| 3,065,120 | A * | 11/1962 | Avelar | 428/454 |
| 3,344,012 | A * | 9/1967 | Af Strom | 428/126 |
| 4,235,657 | A * | 11/1980 | Greenman et al. | 156/234 |
| 4,517,044 | A * | 5/1985 | Arnold | 156/277 |
| 5,894,048 | A * | 4/1999 | Eckart et al. | 428/339 |
| 5,916,502 | A | 6/1999 | Niwa et al. | |
| 2002/0040648 | A1 * | 4/2002 | DeProspero et al. | 101/128.21 |
| 2002/0142111 | A1 * | 10/2002 | Auld et al. | 428/13 |
| 2004/0159969 | A1 * | 8/2004 | Truog et al. | 264/132 |

FOREIGN PATENT DOCUMENTS

| | | |
|---|---|---|
| EP | 0 532 340 | 3/1993 |
| EP | 11059089 | 2/1999 |
| EP | 1 264 704 | 12/2002 |
| JP | 11 059089 | 3/1999 |

* cited by examiner

*Primary Examiner*—Leslie J Evanisko
(74) *Attorney, Agent, or Firm*—Notaro & Michalos P.C.

(57) ABSTRACT

A process produces a plastic pellicle and/or film in a continuous cycle in the print finishing of hides, synthetic materials or any other support in which the printed patterns or other decorative elements are included in at least two film layers.

4 Claims, 1 Drawing Sheet

PROCESS FOR PRODUCING A PLASTIC PELLICLE AND/OR FILM IN A CONTINUOUS CYCLE IN THE PRINT FINISHING OF HIDES, SYNTHETIC MATERIALS OR ANY OTHER SUPPORT

FIELD AND BACKGROUND OF THE INVENTION

The present invention refers to a process for producing a plastic pellicle and/or film in a continuous cycle in the print finishing of hides, synthetic materials or any other support.

As is known, the market offers several types of pre-formed plastic pellicles or films to color paper, cloth, hide and whatever kind of support on which the film is placed.

The said pre-formed pellicles or films are available in several colors, base and neutral colors, and are applied to the support by transferring the image or color through known systems and methods such as dry transfer, hot transfer, cold transfer, pressure and so on.

However, the subject films have many disadvantages. The main disadvantage is the impossibility of obtaining the said films in a continuous cycle simultaneously with the coupling on the final support.

A further disadvantage is that the said films, which are produced in the desired colors and visual elements with the known systems, show the printed patterns on the external side of the film, in superimposition.

As is understandable, the technique produces fragile plastic films that break easily, lose their colors and visual elements, for instance owing to rubbing or the like, unless these films are treated with special agents such as fixing agents.

SUMMARY OF THE INVENTION

All the disadvantages and other ones are removed through a new process for the production of pellicles or films to transfer onto suitable supports as need may require in which there is provided a stratiform plurality of colors and there is the possibility of a continuous print in the inside of the layers that form the film.

The said very innovative process creates a product that has special chromatism, graphics, resistance and adaptability to its support, which makes this product very different from prior products. Besides, this product reaches a high saving in production cost and a consequent lowering of the market price.

BRIEF DESCRIPTION OF THE DRAWING

The only FIGURE in the drawing is a schematic illustration of the process of the invention.

DESCRIPTION OF THE PREFERRED EMBODIMENT

Figure 1:
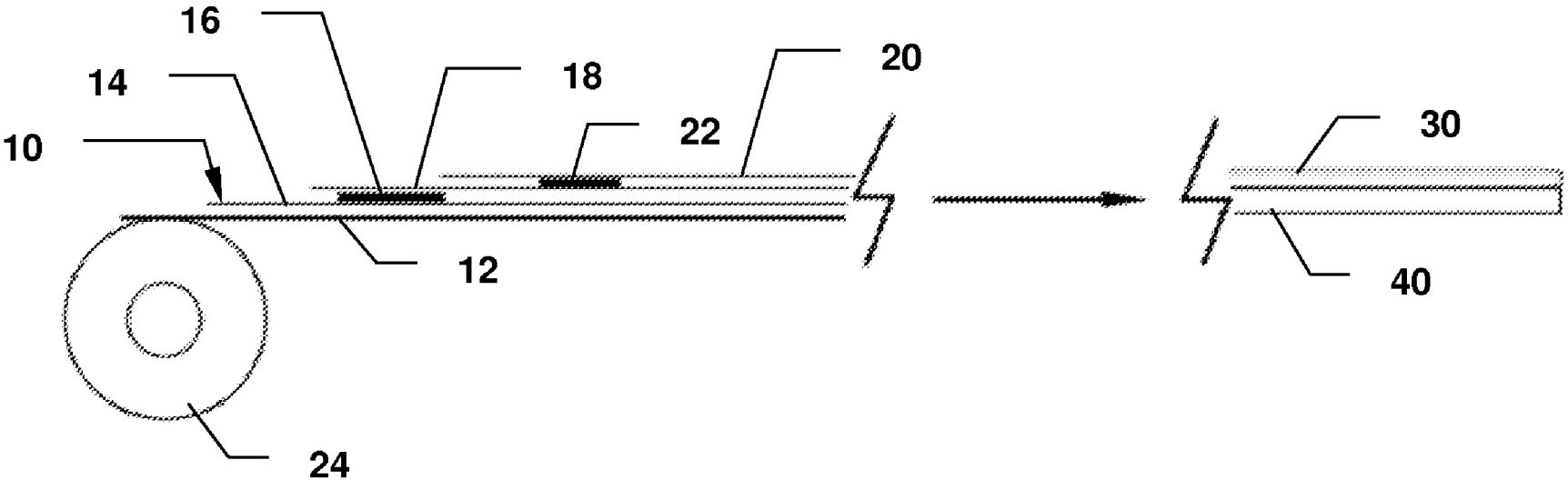

The present invention will be better understood from the following specification that is given as a non-limiting example of one of its possible embodiments.

As is known, transfer films are utilized, for instance in the field of leather and hide industry or the like, to finish natural or synthetic leather or hide. The transfer films 30 in the FIGURE are placed on the leather 40 directly in order to give a particular color or particular graphic/chromatic effects.

The process for producing the films consists in applying at 10 in the FIGURE, a layer of a material such as P.U., P.V.C., acrylic material, rubber, polycarbonate, powders (for instance, in case of pellicles that bear the so-called sequins or spangles) onto a base support 12 that may be a paper support or a support made of another material in order to obtain a colored or neutral layer 14 that is transparent. There are several systems and means to accomplish the said operation, for instance the doctor-scraping operation, the passing of cylinders, the spraying and glazing.

Then, a graphic image 16 is represented on the so-obtained film 14 in a subsequent printing phase such as offset printing, silk-screen printing, thousand-needle printing, flexography, rotogravure process, etc. in one or more colors.

The graphic image is incorporated in a subsequent working phase in which a further layer 18 is applied on the aforesaid layer through a doctor-scraping operation, or passing of cylinders, spraying and glazing or other known system, for instance a manual system or other systems. In this way, the two layers are intimately connected.

Depending on the requirements, the number of the transparent color layers may be also higher, in order to obtain a particular chromatic effect, in such a way as the film may consist of a plurality of overlapped layers 14, 18, 20 of different colors to obtain a special chromatic effect.

In the same way, if a different image 22 is wished, it is sufficient to print the wished image or drawing on one or more layers in order to include the image or drawing in its final form between two pellicle layers.

For instance, to obtain a special effect with the technique according to the present invention, a pellicle is made of the aforesaid material on a support that is preferably, but not necessarily, a paper support or the like by unwinding from a support reel 24.

Once a film showing the wished colors has been obtained by overlapping one or more transparent layers, the wished drawing or image, for instance the logo of a firm or whatever representation is desired, is printed and finished with further doctor-scraping, cylinder passing, spraying and glazing in order to incorporate the print.

In this way, it is possible to apply the so-obtained film on hide and/or synthetic materials, giving to the logo (of the present example) a "fluctuating" effect, because the print seems to be in suspension.

It is obvious that the process according to the present invention obtains and uses films according to numberless possibilities which are all included in the scope of protection of the present invention, on taking into account the solution, which contemplates the print or insertion of other materials which are incorporated between more film layers by utilizing the so-described means and materials.

A technician of the field can modify the so-described process and obtain solutions that are to be considered as included in the scope of protection of the invention as further defined by the following claims.

The invention claimed is:

1. A process for producing a plastic pellicle or film, comprising the steps of:

continuously applying a first transparent layer of synthetic material on a base support through a first spraying and glazing, doctor-scraping or cylinder passing operation;

providing a first desired graphic image on an inner surface of the first transparent layer opposite the base support; and applying at least one overlap layer over the first desired graphic image and the inner surface of the first transparent layer through a second spraying and glazing, doctor-scraping or cylinder passing operation and thereby intimately connecting the at least one overlap layer and the first transparent layer to form a multi-layer film;

the multi-layer film comprising two or more overlap layers, the overlap layers being transparent and wherein the overlap layers are in different colors to provide different chromatic effects for the multi-layer film.

2. A process according to claim 1, wherein a subsequent graphic image is provided between two neighboring overlap layers.

3. A process according to claim 2, wherein the multi-layer film, which is obtained by overlapping the first transparent and overlap layers and the first and subsequent graphic images, has fluctuating image characteristics.

4. A process according to claim 3, wherein the multi-layer film is adapted to finish a surface of a natural or synthetic leather or hide.

* * * * *